US007789807B1

(12) United States Patent
Wang

(10) Patent No.: US 7,789,807 B1
(45) Date of Patent: Sep. 7, 2010

(54) FOLDING MECHANISM OF A TREADMILL

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 12/568,653

(22) Filed: Sep. 28, 2009

(51) Int. Cl.
*A63B 22/02* (2006.01)

(52) U.S. Cl. ..... 482/54; 482/52

(58) Field of Classification Search ..... 482/51, 482/52, 54, 148, 908; 601/23, 33, 34, 35
See application file for complete search history.

(56) References Cited

U.S. PATENT DOCUMENTS 6,090,016 A * 7/2000 Kuo ..... 482/54
6,857,991 B2 * 2/2005 Yu ..... 482/54
6,890,287 B2 * 5/2005 Chen ..... 482/54
7,569,000 B2 * 8/2009 Wang ..... 482/54
2009/0124465 A1 * 5/2009 Wang ..... 482/54
2009/0163326 A1 * 6/2009 Wang ..... 482/54
2009/0239716 A1 * 9/2009 Wang ..... 482/54

* cited by examiner

*Primary Examiner*—Loan Thanh
*Assistant Examiner*—Tam Nguyen

(57) ABSTRACT

A folding mechanism of a treadmill having a base frame with a rear support frame at the bottom thereof. The rear support frame is supported by the pneumatic cylinder. In folding the treadmill upward or downward, the rear support frame can be pushed by the pneumatic cylinder such that the base frame is easily brought in an upright storage position or in a horizontal operation position. Moreover, the rear end of the rear support frame is provided with universal ground-touching rollers that may be locked in place or unlocked for a practical movement of the treadmill and an easy change in direction.

1 Claim, 7 Drawing Sheets

FOLDING MECHANISM OF A TREADMILL

BACKGROUND OF THE INVENTION

1. Fields of the Invention

The invention relates to a folding mechanism of a treadmill, and more particularly, to a folding mechanism that properly provides both an auxiliary force and a support force when the base frame of the treadmill is folded or unfolded. Meanwhile, a practical movement of the treadmill and an easy change in direction are effectively achieved as well.

2. Description of the Related Art

As well-known, the conventional treadmill has a large volume and a great weight. As a result, the base frame thereof is designed to be foldable in a upright position for an easy movement and a practical storage. Of course, the folding structure has been a basic design of the treadmill. Moreover, it can be roughly divided into an electric and a manual folding mechanism. The invention is aimed at the improvement of the manual folding mechanism.

Among the conventional treadmills, they can't properly provide an auxiliary force and a support force when the base frame of the treadmill is folded or unfolded (in an operational position). In other words, there are no devices (in the conventional treadmills with the manual folding mechanism) for giving the operator aid in conducting the folding action. It is therefore unsuitable for those who has a weak physical condition or for women to carry out the folding or unfolding process by themselves. Actually, the potential risk to cause the body injuries exists. Thus, the conventional structure requires further improvements to eliminate the above-mentioned drawbacks.

SUMMARY OF THE INVENTION

A primary object of the invention is to provide a folding mechanism of a treadmill having a base frame supported by the pneumatic cylinder. In folding the treadmill upward or downward, the pneumatic cylinder provides both an auxiliary force and a support force acting on the rear support frame. Meanwhile, the rear end of the rear support frame is provided with universal ground-touching rollers that serves as auxiliaries for a practical movement of the treadmill and an easy change in direction According to the invention, a folding mechanism of a treadmill has a base frame with a rear support frame at the bottom thereof. The rear support frame is supported by the pneumatic cylinder. In folding the treadmill upward or downward, the rear support frame can be pushed by the pneumatic cylinder such that the base frame is easily brought in an upright storage position or in a horizontal operation position. Moreover, the rear end of the rear support frame is provided with universal ground-touching rollers that may be locked in place or unlocked for a practical movement of the treadmill and an easy change in direction.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
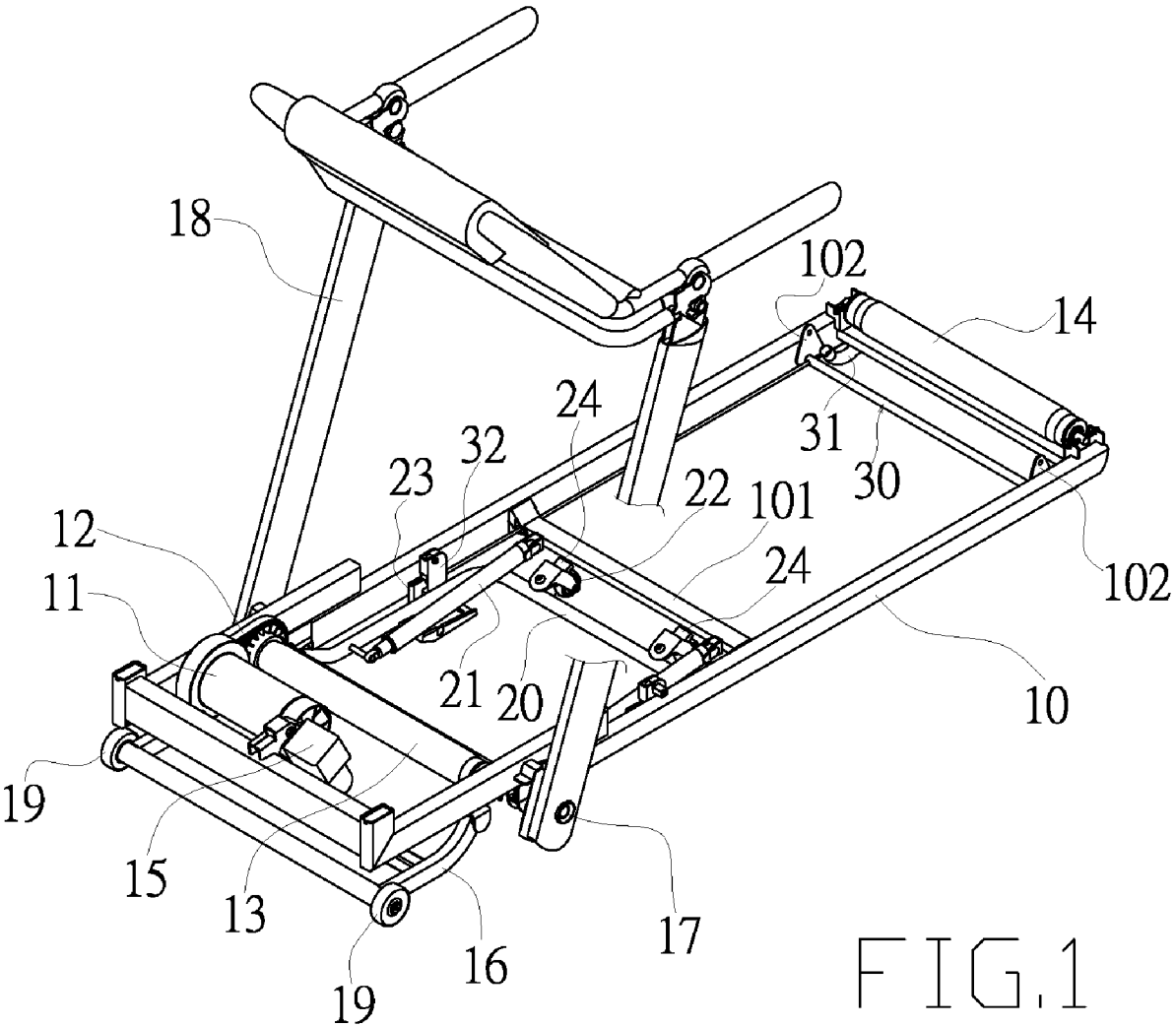
FIG. 1 is a perspective view of a preferred embodiment of the invention.
Figure 2:
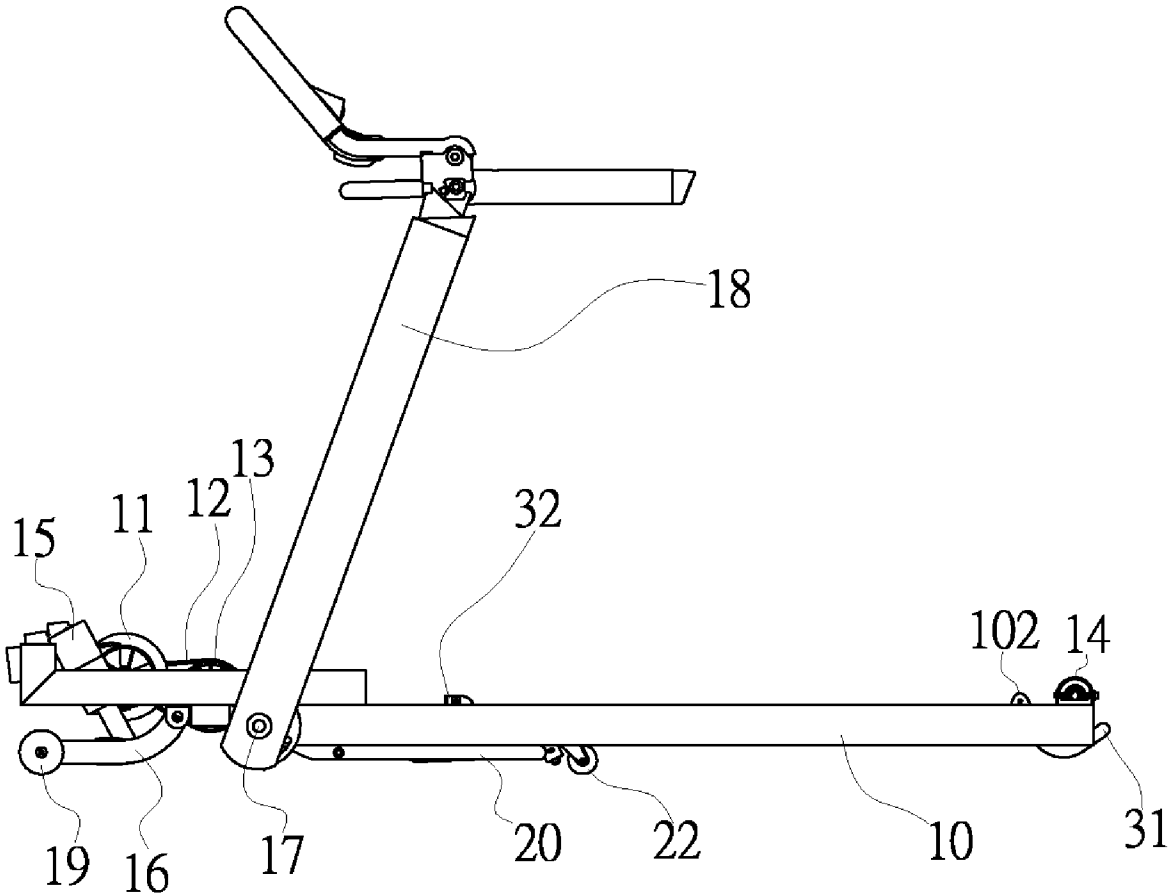
FIG. 2 is a side view of the preferred embodiment of the invention according to FIG. 1.
Figure 3:
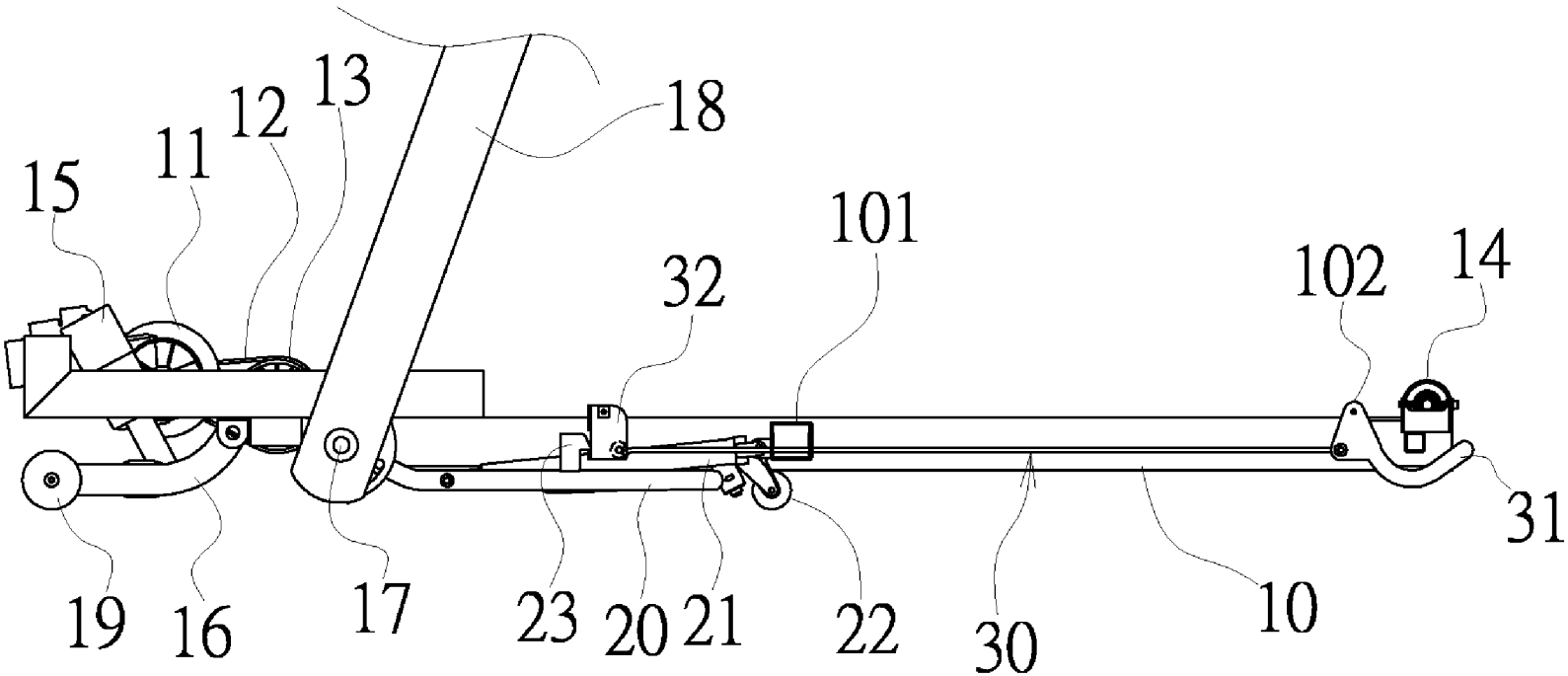
FIG. 3 is a side view of the preferred embodiment of the invention according to FIG. 2, showing that the locking mechanism is in a locked state.

Referring to FIGS. 1 through 3, a drive motor unit 11 is installed at one side of a base frame 10 of a treadmill. A continuous moving belt (not shown) is driven in rotation by use of a drive belt 12, a front roller 13 and a rear roller 14. Moreover, a lifting motor 15 is employed to control the height of an adjusting support 16 for adjusting the supporting angle of the base frame 10. In addition, a mounting pin 17 is positioned at each of two sides of the base frame 10 for pivotally connecting a handrail unit 18 and a rear support frame 20.

Besides, a pneumatic cylinder 21 is installed at each of two sides of a central strengthening rod 101 of the base frame 10. The other side of the pneumatic cylinder 21 is directly pushed against a corresponding portion of the rear support frame 20. The distal end of the rear support frame 20 is provided with universal ground-touching rollers 22 that are in constant contact with the ground.

A locking mechanism 30 is positioned under a strengthening member 102 at the distal end of the base frame 10. A barbed hook 23 positioned at the rear support frame 20 may be locked by the locking mechanism 30 when the base frame 10 is moved in a horizontal operation position (see FIG. 3).

Figure 4:
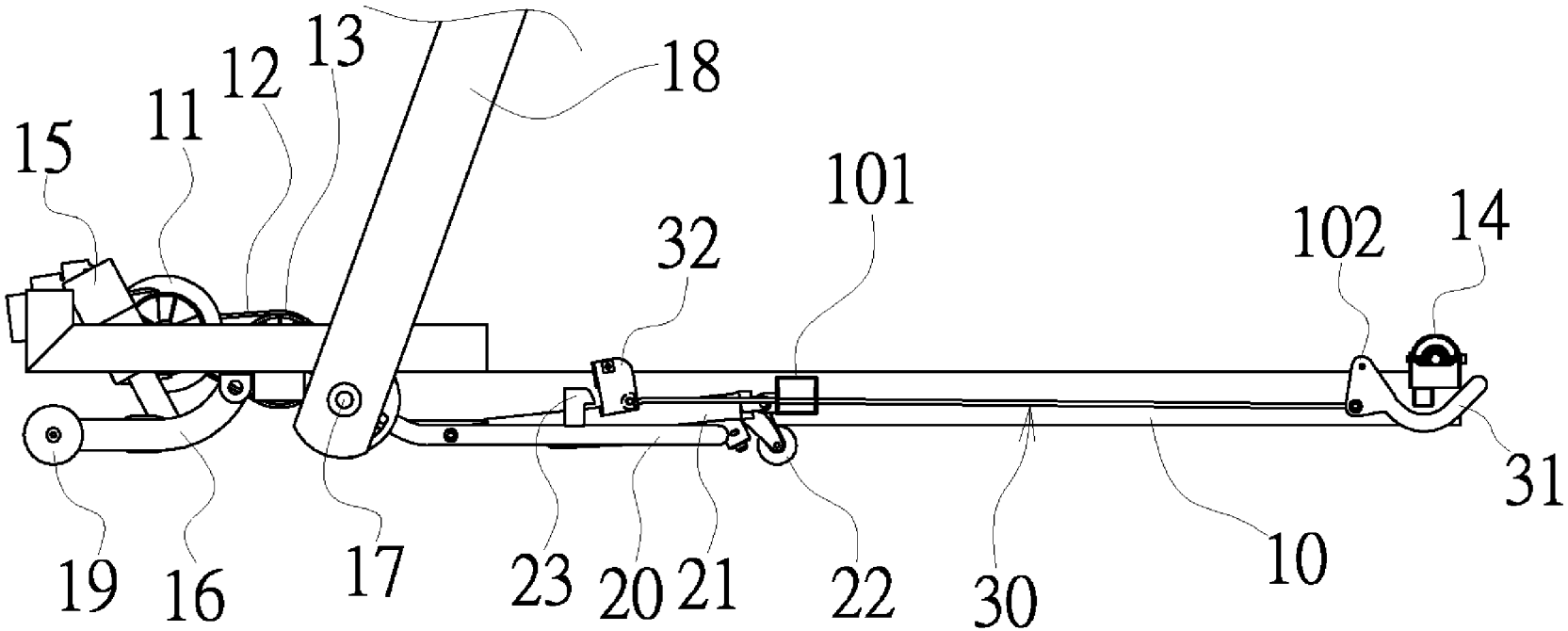
FIG. 4 is a side view of the preferred embodiment of the invention according to FIG. 3, showing that the locking mechanism is in a unlocked state.

As shown in FIG. 4, a release lever 31 of the locking mechanism 30 is moved in such a way that the a hook portion 32 at the other end thereof is detached from the barbed hook 23 of the rear support frame 20 for bringing the base frame 10 in an upright storage position. In this way, the base frame 10 may be moved upward in position (see FIGS. 5 and 6).

Figure 5:
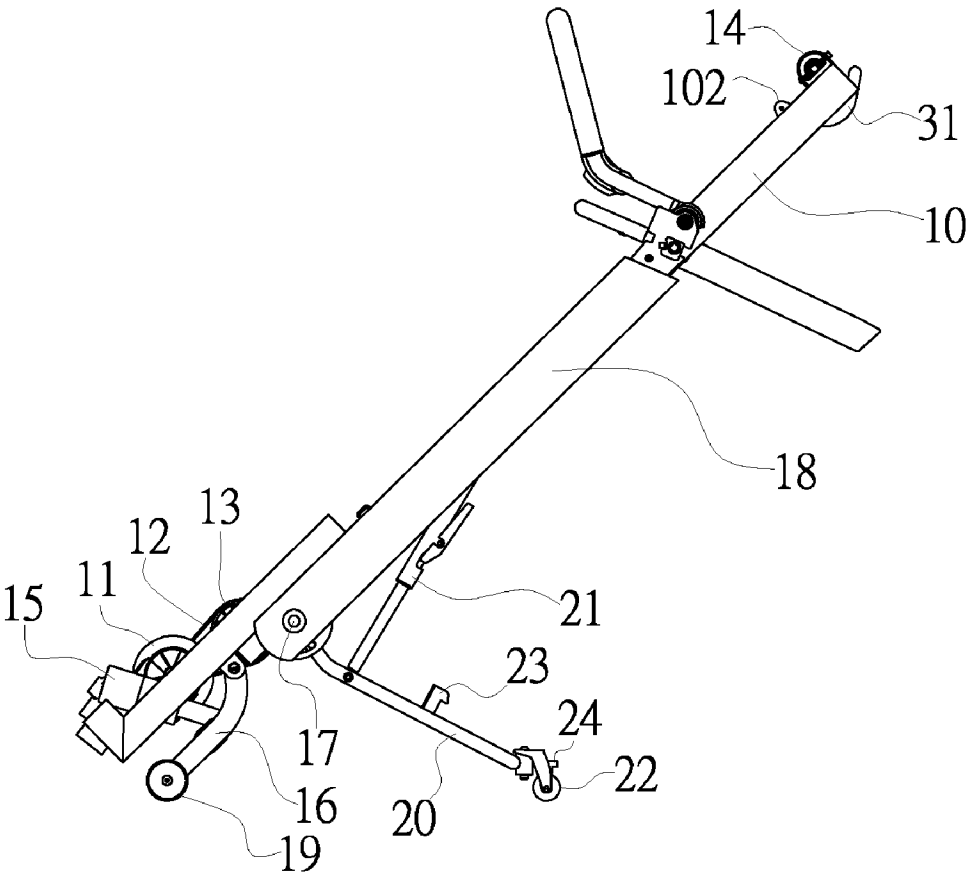
FIG. 5 is a schematic drawing of the invention, showing the action in folding the base frame.
Figure 6:
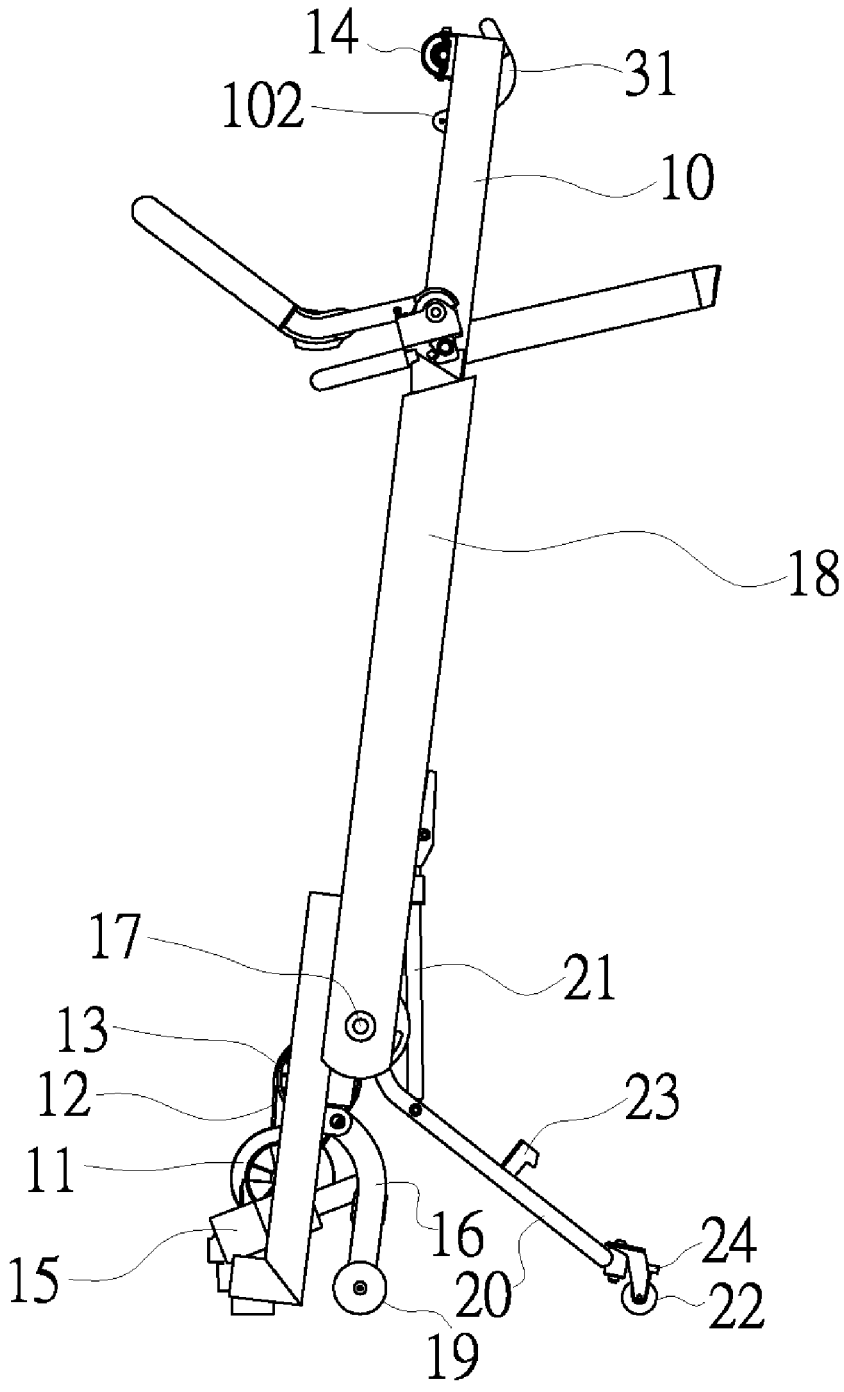
FIG. 6 is a schematic drawing of the invention, showing that the base frame is folded in an upright position.
Figure 7:
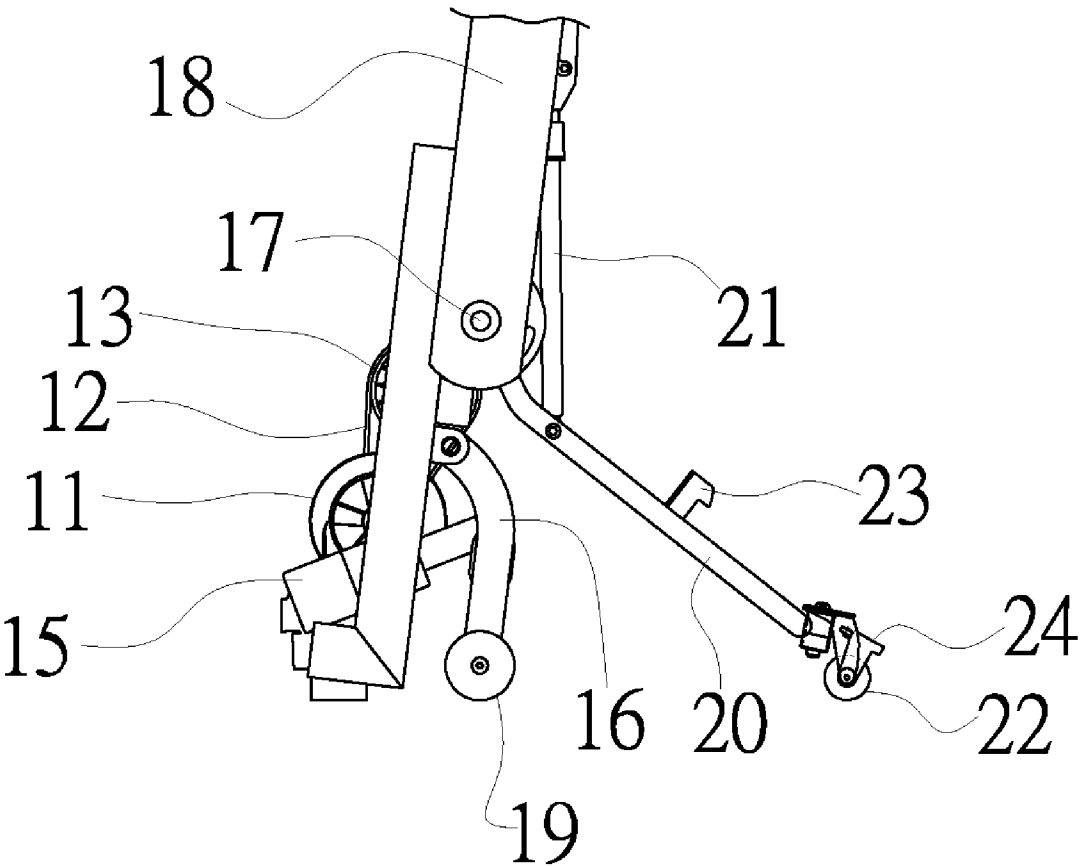
FIG. 7 is a schematic drawing of the invention, showing that the universal ground-touching rollers are in a released position.

In the ordinary state, the universal ground-touching roller 22 is secured by a lock pin 24 in place for conducting a rotary motion only in a straight direction (see FIGS. 5 and 6). In turning the treadmill, the lock pin 24 may be removed (see FIG. 7) for changing the movement direction of the universal ground-touching roller 22.

Based upon the assembly of the above-mentioned components, the pneumatic cylinder 21 is moved by the weight of the base frame 10 in a compressed state when the base frame 10 is brought in the horizontal operation position. To the contrary, the pneumatic cylinder 21 provides a proper pushing force (auxiliary force) to move the rear support frame 20 smoothly toward the front end of the base frame 10 until the base frame 10 is located in an upright storage position. At that time, the base frame 10 is stably supported by the ground-touching rollers 19 at both ends of the adjusting support 16 and the universal ground-touching rollers 22 at the distal end of the rear support frame 20 that are all in contact to the ground.

Likewise, the rear support frame 20 and the universal ground-touching rollers 22 thereof are moved in a ground-touching way when the base frame 10 is moved downward by the operator. At the same time, the base frame 10 is lowered to the horizontal position under the influence of the pneumatic cylinder 21 providing a cushioning effect (or the auxiliary support). As a result, a stable and effort-saving effect is achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill comprising a drive motor unit installed at one side of a base frame of the treadmill, a continuous moving belt adapted to support a user being driven in rotation by use of a drive belt, a front roller and a rear roller a folding mechanism having, a lifting motor being employed to control the height of an adjusting support for adjusting a supporting angle of the base frame relative to a support surface such that the moving belt can be inclined, a mounting pin being positioned at each of two sides of the base frame for pivotally connecting a handrail unit and a rear support frame to the base frame, wherein a pneumatic cylinder is installed at one end thereof at each of two sides of a central strengthening rod of the base frame, and the other end of the pneumatic cylinders are directly pushed against corresponding lateral portions of the rear support frame, and the distal end of the rear support frame is provided with universal ground-touching rollers that are in constant contact with the ground; and wherein a locking mechanism is positioned under a strengthening member at the distal end of the base frame, and a barbed hook positioned at the rear support frame may be locked by the locking mechanism when the base frame is moved in a horizontal operation position, wherein a release lever is positioned at one end of the locking mechanism while a hook portion is disposed at the other end thereof such that a user can actuate the release lever to unhook the hook portion from the barbed hook to allow for the treadmill to be folded.

* * * * *